United States Patent [19]

Clark et al.

[11] Patent Number: 4,979,361

[45] Date of Patent: Dec. 25, 1990

[54] STEPPED DIFFUSER

[75] Inventors: Jim A. Clark, Jupiter; James H. Shadowen, Riviera Beach; Barton R. Field, Jupiter, all of Fla.

[73] Assignee: United Technologies Corporation, Hartford, Conn.

[21] Appl. No.: 379,310

[22] Filed: Jul. 13, 1989

[51] Int. Cl.[5] ..... F02C 3/04

[52] U.S. Cl. ..... 60/39.36; 60/751

[58] Field of Search ..... 60/751, 39.36

[56] References Cited

U.S. PATENT DOCUMENTS

| | | | |
|---|---|---|---|
| 3,631,674 | 1/1972 | Taylor | 60/39.36 |
| 4,272,955 | 6/1981 | Hoffman et al. | 60/751 |
| 4,497,445 | 2/1985 | Adkins et al. | 60/751 |
| 4,796,429 | 1/1989 | Verdouw | 60/751 |

*Primary Examiner*—Louis J. Casaregola
*Assistant Examiner*—Timothy S. Thorpe

[57] ABSTRACT

The diffuser for delivering compressor discharge air to the combustor of a gas turbine engine includes a predifuser mounted ahead of a dump diffuser which includes step changes in the flow path at its inlet and adjacent the cowl of the combustor in the passageway of the dump diffuser for providing at least two sudden expansions of the diffuser flow.

4 Claims, 1 Drawing Sheet

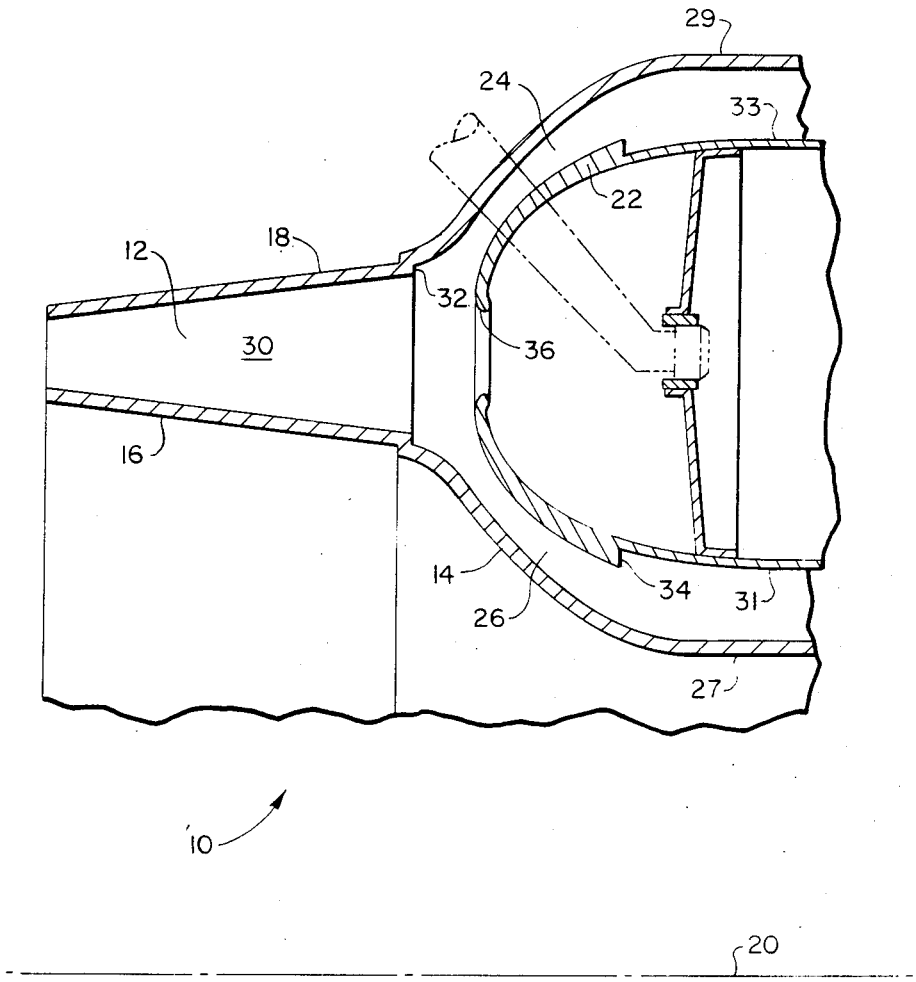
29
24
33
22
12
18
32
30
36
16
14
34
31
26
27
10
20

STEPPED DIFFUSER

TECHNICAL FIELD

This invention relates to gas turbine engines and particularly to the construction of its diffuser.

BACKGROUND ART

As is well-known, the diffuser for a gas turbine engine converts compressor discharge air dynamic pressure to static pressure to allow air to enter the combustor with minimal combustor section pressure loss. The greater the diffuser pressure recovery, the less is the penalty to the engine cycle. Typically, the diffuser consists of a prediffuser upstream of a dump diffuser, which feeds air into and around an aerodynamically shaped cowl located ahead of the combustor. Though its performance is not ideal, a dump diffuser provides good pressure recovery in a short axial distance, and its performance is insensitive to the velocity profile at the inlet of the prediffuser.

An example of a prediffuser/dump diffuser is disclosed in U.S. Pat. No. 4,272,955 granted to J. S. Hoffman and M. E. Abreu on June 16, 1981 to which reference is made for details of diffuser construction. In this patent, supra, the dump diffuser is designed to include steps located axially in the direction toward the combustor. The steps are provided by including generally squared-off shoulders formed on the outer and inner walls of the diffuser itself. In this arrangement, the wall of the cowl ahead of the combustor is formed in a smooth surface defining an aerodynamically shaped member for providing a smooth transition of the flow into the shrouds of the combustor.

As shown in the U.S. Pat. No. 4,272,955, supra, two sudden expansions, one at the prediffuser exit and the other downstream therefrom adjacent the diffuser outer wall are provided. This dual step arrangement distinguishes over the single large sudden expansion at the prediffuser exit and it has been found that the dual step is more efficacious than the single step of the heretofore known dump diffuser designs.

Other types of dump diffusers consist of a single, large, sudden expansion in flow area immediately downstream of the prediffuser exit.

The current invention replaces the single step expansion of a conventional dump diffuser with multiple steps, at different axial locations; the multiple step arrangement has been found to more effectively convert dynamic pressure to static pressure than do heretofore known dump diffusers. In particular, locating one of the steps on the contoured surfaces of the combustor cowl while reducing the size of the step at the prediffuser exit has been shown to reduce the sudden expansion losses measured in the dump diffuser. Since expansion losses are linked to air velocity upstream of the expansion, the improved performance of the multiple step diffuser is attributable to delaying some of the expansion until velocity is reduced due to the area increase of the first sudden expansion.

Test results from a full-size, 2-D diffuser rig simulating the current diffuser (one-step) geometry or the stepped diffuser geometry reveal that the pressure recovery in the two-step design is higher than that in the one-step design. Likewise, 1-D calculations show that multiple step designs should be superior in pressure recovery. This invention contemplates that the dump diffuser should include at least two steps, one at the prediffuser exit, and the second downstream, adjacent to the cowl. In a design with more than two steps, two of the steps would be those mentioned above.

DISCLOSURE OF THE INVENTION

An object of this invention is to provide an improved dump diffuser for a gas turbine engine.

A still further object of this invention is to include at least two expansions in the dump diffuser, using a stepped cowl to achieve one of the expansions.

The foregoing and other features and advantages of the present invention will become more apparent from the following description and accompanying drawings.

BRIEF DESCRIPTION OF THE DRAWING

The sole FIGURE is a schematic view partly in section showing a dump diffuser employing this invention in an annular combustor configuration.

BEST MODE FOR CARRYING OUT THE INVENTION

While in its preferred embodiment this invention is being shown in an annular combustor for a gas turbine engine, as one skilled in the art will appreciate, the invention may be equally employed in other combustor configurations.

As noted above, the diffuser section generally illustrated by reference numeral 10 comprises the prediffuser 12 and dump diffuser 14. The diffusers are defined by the inner annular wall 16 and the outer annular wall 18 coaxially mounted about the engine's centerline 20 but diverging to progressively enlarge the passageway from the inlet to outlet. The dump diffuser 14 is further defined by the annularly shaped cowl 22 of the annular combustor. The cowl serves to define an aerodynamic surface to smoothly turn some of the flow leaving the prediffuser and entering the annular passageways 24 and 26 formed by the inner annular wall 27, the outer annular wall 29, the inner annular liner 31, and the outer annular liner 33.

As is customary, compressor discharge air is delivered to the annular prediffuser 12 where the air is partially decelerated before it splits into three flows in the dump diffuser 14. A step 32 is formed at the prediffuser exit so that air there experiences a sudden expansion, which would be typically less than a single dump diffuser of heretofore known types. Some of the prediffuser exit air enters the cowl opening 36. The remaining air, flowing in the annular passages 24 and 26 downstream of the first sudden expansion is subjected to a second sudden expansion created by the step 34 formed in the annularly shaped cowl 22. In this arrangement, the second sudden expansion occurs adjacent to the combustor cowl, and the diffusing passage is also adjacent to the combustor cowl.

Although this invention has been shown and described with respect to detailed embodiments thereof, it will be understood by those skilled in the art that various changes in form and detail thereof may be made without departing from the spirit and scope of the claimed invention.

We claim:

1. For a gas turbine engine having an annular combustor including a cowl enclosing said combustor at the upstream end of the combustor, a prediffuser having an inner wall and an outer wall angularly disposed defining a progressively enlarged annular passageway, a dump diffuser having a second outer wall and a second inner wall defining with said cowl a second progressively enlarged passageway and a third progressively enlarged passageway being disposed relative to said prediffuser to split the flow so that a portion is directed toward said second progressively enlarged passageway and another portion is directed toward said third progressively enlarged passageway, an annular step formed on said cowl projecting in said second passageway and said third progressively enlarged passageway permitting the flow therein to expand as it flows axially in said second and third passageways and a pair of steps upstream from said annular step at the juncture of the discharge end of said prediffuser and inlet of said dump diffuser in said second inner and said outer walls whereby another expansion of the flow in said second passageway and said third passageway occurs.

2. For a gas turbine engine as claimed in claim 1 wherein said inner wall and said outer wall are disposed coaxially about said gas turbine engine's center line.

3. For a gas turbine engine as claimed in claim 2 wherein said step in said cowl is in the passageway of said dump diffuser.

4. For a gas turbine engine as claimed in claim 3 wherein said second inner wall and said second outer wall define a smooth transition for defining a clean aerodynamic surface for the flow in said second passageway.

* * * * *